US007604047B2

(12) United States Patent
Broussard

(10) Patent No.: US 7,604,047 B2
(45) **Date of Patent: *Oct. 20, 2009**

(54) UNIVERSAL TUBING HANGER SUSPENSION ASSEMBLY AND WELL COMPLETION SYSTEM AND METHOD OF USING SAME

(75) Inventor: Earl Broussard, Houston, TX (US)

(73) Assignee: Argus Subsea, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/049,093

(22) Filed: Mar. 14, 2008

(65) Prior Publication Data

US 2008/0156478 A1 Jul. 3, 2008

Related U.S. Application Data

(63) Continuation of application No. 11/216,227, filed on Aug. 31, 2005, now Pat. No. 7,419,001.

(60) Provisional application No. 60/682,250, filed on May 18, 2005.

(51) Int. Cl.
*E21B 23/01* (2006.01)

(52) U.S. Cl. ..... 166/75.14; 166/382; 166/368

(58) Field of Classification Search ..... 166/77.51, 166/382, 360, 368, 75.14
See application file for complete search history.

(56) References Cited

U.S. PATENT DOCUMENTS

| | | | | |
|---|---|---|---|---|
| 2,948,338 | A | 8/1960 | Raulins et al. | |
| 3,318,384 | A | 5/1967 | Brown | |
| 3,531,236 | A | 9/1970 | Braddick et al. | |
| 3,990,510 | A | 11/1976 | Decuir | |
| 4,067,385 | A | 1/1978 | Schwager et al. | |
| 4,146,093 | A | 3/1979 | Horvath et al. | |
| 4,154,298 | A * | 5/1979 | Gano | 166/85.5 |
| 4,296,806 | A | 10/1981 | Taylor et al. | |
| 4,496,162 | A | 1/1985 | McEver et al. | |
| RE31,933 | E | 7/1985 | Taylor et al. | |
| 4,791,986 | A | 12/1988 | Vallet | |
| 4,817,716 | A | 4/1989 | Taylor et al. | |
| 4,832,125 | A | 5/1989 | Taylor | |
| 5,046,557 | A | 9/1991 | Manderscheid | |

(Continued)

FOREIGN PATENT DOCUMENTS

GB 2397312 A 7/2004

OTHER PUBLICATIONS

European Search Report of related application No. 05257653.5, Aug. 2006, 7 pages.

*Primary Examiner*—Shane Bomar
(74) *Attorney, Agent, or Firm*—Douglas W. Rommelmann; Andrews Kurth LLP

(57) ABSTRACT

A tubing hanger suspension assembly for an oil and gas well completion system and a method of installing same. The tubing hanger suspension assembly includes a tubing hanger housing which is positioned in the wellhead housing. The tubing hanger assembly includes a sealing and lockdown mechanism capable of providing sealing and load support of the production tubing in the production casing string. A stab sub assembly connected to the upper end of the tubing hanger suspension assembly and lower end of the Christmas tree assembly provides downhole hydraulic and electric functionality and annulus access to the production tubing.

32 Claims, 9 Drawing Sheets

U.S. PATENT DOCUMENTS 5,411,099 A 5/1995 Braddick
5,462,119 A 10/1995 de Souza et al.
5,501,281 A 3/1996 White et al.
5,544,707 A 8/1996 Hopper et al.
5,743,333 A 4/1998 Willauer et al.
5,875,852 A 3/1999 Floyd et al.
5,904,207 A 5/1999 Rubbo et al.
5,944,102 A 8/1999 Kilgore et al.
5,988,276 A 11/1999 Oneal
6,009,951 A 1/2000 Coronado et al.
6,109,352 A 8/2000 Edwards et al.
6,112,811 A 9/2000 Kilgore et al.
6,138,751 A 10/2000 Hart
6,186,227 B1 2/2001 Vaynshteyn et al.
6,227,301 B1 5/2001 Edwards et al.
6,349,772 B2 2/2002 Mullen et al.
6,360,822 B1 * 3/2002 Robertson ..... 166/368
6,386,292 B1 5/2002 Bland
6,530,574 B1 3/2003 Bailey et al.
6,554,062 B1 4/2003 Dewey et al.
6,609,567 B2 8/2003 Ingram et al.
6,640,902 B2 11/2003 Baten et al.
6,719,063 B2 4/2004 Adams et al.
6,758,272 B2 7/2004 Bixenman et al.
6,769,491 B2 8/2004 Zimmerman et al.
6,808,022 B2 10/2004 Smith
6,808,024 B2 10/2004 Schwendemann et al.
6,854,521 B2 2/2005 Echols et al.
6,902,005 B2 * 6/2005 Radi et al. ..... 166/345
7,128,143 B2 * 10/2006 Van Bilderbeek ..... 166/96.1
2003/0116328 A1 6/2003 Doane et al.
2003/0155126 A1 * 8/2003 Radi et al. ..... 166/350
2005/0006107 A1 1/2005 Nguyen et al.

* cited by examiner

UNIVERSAL TUBING HANGER SUSPENSION ASSEMBLY AND WELL COMPLETION SYSTEM AND METHOD OF USING SAME

CROSS-REFERENCE TO RELATED APPLICATIONS

This application is a continuation of U.S. application Ser. No. 11/216,227, filed Aug. 31, 2005, now U.S. Pat. No. 7,419,001, which claims priority to U.S. Provisional Application Ser. No. 60/682,250, filed May 18, 2005, which is hereby incorporated by reference in its entirety.

BACKGROUND OF THE INVENTION

1. Field of the Invention

The present invention relates to a subsea wellhead assembly for an oil and gas well, and more particularly relates to a universal tubing hanger suspension assembly for use in a subsea wellhead assembly.

2. Description of the Related Art

A typical subsea wellhead assembly includes a wellhead housing installed at the sea floor. With a drilling blowout preventer (BOP) stack installed on the wellhead housing, the well bore is drilled while successively installing concentric casing strings in the well bore. Typically, each successive casing string is cemented at its lower end and includes a casing hanger sealed with a mechanical seal assembly at its upper end in the wellhead housing.

In order to produce the cased well, a production tubing string and tubing hanger is typically run into the well bore through the BOP stack and the tubing hanger is landed, sealed and locked in the wellhead housing and/or the casing hanger. Upon sealing the bore(s) extending through the tubing hanger, the BOP stack is removed and a Christmas tree is lowered onto the wellhead housing. A Christmas tree is an oilfield term understood to include the control valves and chokes assembled at the top of a well to control the flow of oil and gas. It is vitally important to the operation and safety of the well that the proper connections are remotely formed between the Christmas tree, the wellhead housing, and the tubing hanger.

In a conventional completed well system, the Christmas tree is connected to the top of the wellhead housing over the tubing hanger. The tubing hanger supports at least one production tubing string which extends into the well bore. The tubing hanger provides a production bore within the tubing string and a conduit that communicates with the annulus surrounding the tubing string and inside the innermost or production casing string. In addition, the tubing hanger comprises at least one vertical production bore for communicating fluid between the tubing string and a corresponding production bore in the Christmas tree, and typically at least one vertical annulus bore for communicating fluid between the tubing annulus and a corresponding annulus bore in the Christmas tree. The tubing hanger may additionally include one or more service and control conduits for communicating control fluids and well chemicals through the tubing hanger or electrical power to devices or positions located in or below the tubing hanger.

A tubing hanger conventionally is sealed and rigidly locked into the wellhead housing or component in which it is landed. In a well having a conventional Christmas tree, the tubing hanger is landed in the wellhead housing. The tubing hanger typically includes an integral locking mechanism which, when activated, secures the tubing hanger to the wellhead housing or a profile in the casing hanger. The locking mechanism ensures that any subsequent pressure from within the well acting on the tubing hanger will not cause the tubing hanger to lift from the wellhead housing thereby resulting in an unsafe condition.

There are a limited number of subsea wellhead equipment manufacturers worldwide. Currently, the primary manufacturers of subsea wellhead housings are ABB Vetco Gray, Cooper Cameron Corp., Dril-Quip, FMC and Kvaerner. Each of the primary manufacturers has its own proprietary wellhead housing and casing hanger designs, dimensions and details. Quite frequently, a well is completed on Manufacturer A's wellhead housing and casing hangers using a tubing hanger and/or Christmas tree from Manufacturer B. However, since Manufacturer A's housing and casing hanger design is proprietary, Manufacturer B may not be able to connect its Christmas tree to Manufacturer A's housing without a license from Manufacturer A at a fee in order to design Manufacturer B's equipment to properly interconnect and mate with Manufacturer A's wellhead housing and casing hanger. This results in a substantial amount of additional engineering and costs or additional equipment (such as a tubing spool) when electing to purchase Manufacturer B's equipment for use with Manufacturer A's wellhead housing. Since each wellhead housing/system manufacturer has multiple models of housings and casing hangers with different proprietary details, it is not practical or economical for other manufacturers to build up an inventory of equipment for installation on other manufacturers' wellhead equipment. In addition to the added costs, it also increases the delivery time which is often vitally important to the well owner.

It is desirable to have a subsea well completion system that is adapted for use with wellhead housings from all manufacturers. It is further desirable to have a tubing hanger assembly adapted for positioning in the wellhead housing independently of any proprietary details of the wellhead housing. It is further desirable to have a universal tubing hanger assembly that is adapted for use in a plurality of wellhead housings, and even more desirable to have a universal tubing hanger assembly adapted for use in wellhead housings of two or more manufacturers.

SUMMARY OF THE INVENTION

The present invention includes a tubing hanger suspension assembly for an oil and gas well completion system and a method of installing same. The tubing hanger suspension assembly includes a tubing hanger housing which is positioned in the wellhead housing. The tubing hanger assembly includes a sealing and lockdown mechanism capable of providing sealing and load support of the production tubing in the production casing string. A stab sub assembly connected to the upper end of the tubing hanger suspension assembly and lower end of the Christmas tree assembly provides downhole hydraulic and electric functionality and annulus access to the production tubing.

The well completion system of the present invention is adapted for use with wellhead housings from all manufacturers. The tubing hanger suspension assembly of a preferred embodiment includes a tubing hanger housing positioned in the wellhead housing independently of any proprietary details of the wellhead housing. The preferred embodiment of the tubing hanger suspension assembly is "universal", i.e., adapted for use in a plurality of wellhead housings, including wellhead housings of two or more manufacturers.

BRIEF DESCRIPTION OF THE SEVERAL VIEWS OF THE DRAWINGS

The objects, advantages, and features of the invention will become more apparent by reference to the drawings which are appended hereto and wherein like numerals indicate like parts and wherein an illustrated embodiment of the invention is shown, in which.

DETAILED DESCRIPTION OF PREFERRED EMBODIMENTS OF THE INVENTION

Figure 1:
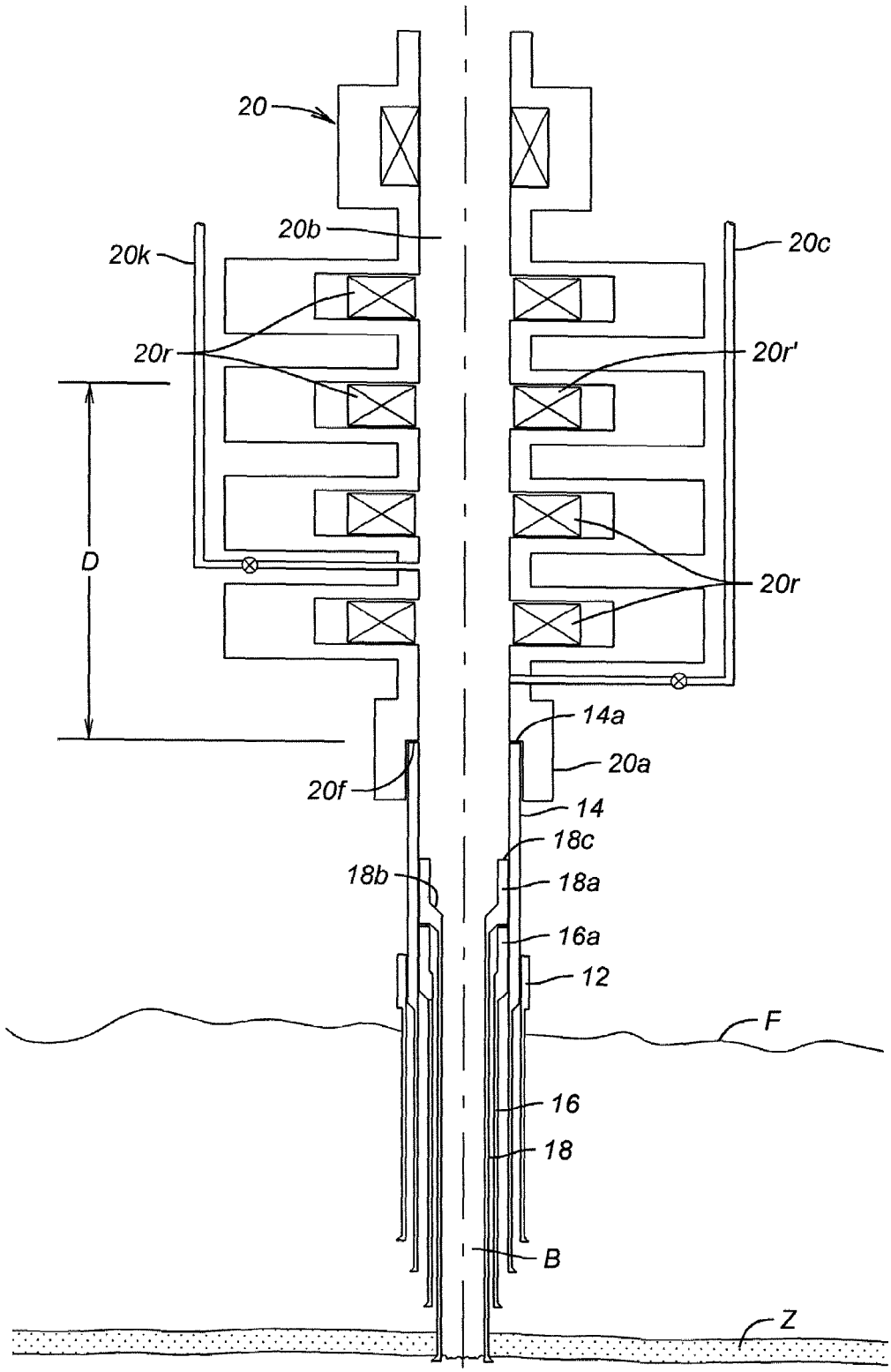
FIG. 1 is a schematic sectional elevation view showing a cased well bore, a wellhead housing, a blowout preventer ("BOP") stack connected to the wellhead housing, and casing strings with casing hangers landed in the wellhead housing.

An embodiment of the invention is described in detail with specific reference to the drawings. This invention concerns completion of a well that has been drilled and which has its bore hole lined with casing. Referring to FIG. 1, a typical drilled well bore B is shown extending from the sea floor F down to a zone Z, typically communicating with a reservoir of hydrocarbon fluids. The well bore B is shown having a series of tubular strings of casing pipe extending from the sea floor F down into the bore B as is well known in the art. The series of pipe strings, beginning from the outermost string, includes a conductor housing 12, a wellhead housing 14, a first or outer casing string 16 with hanger 16*a*, and an inner or production casing string 18 with hanger 18*a*. It is to be understood that the well depicted in FIG. 1 is merely representative of a typical well for purposes of illustrating the present invention, and thus the present invention is not limited to wells of this precise configuration. Additionally, it is to be understood that the figures are not drawn to scale due to the tremendous depths to which wells are drilled.

Still referring to FIG. 1, the top of the conductor housing 12 is preferably above the sea floor F. The wellhead housing 14, preferably a high pressure housing, extends above the conductor housing 12. Preferably, the top of the wellhead housing 14 is about ten feet above the sea floor F. The wellhead housing 14 typically includes an external profile (not shown) for connection with a connector 20*a* of a blowout preventer ("BOP") stack 20 and an oilfield Christmas tree as will be described below. Typically, the casing hangers 16*a* and 18*a* are landed and secured in the wellhead housing 14.

Although not shown, the wellhead housing 14 typically includes several internal profiles, dimensions and details for landing, locking and sealing the stacked casing hangers 16*a*, 18*a* in the wellhead housing 14. Each wellhead manufacturer has several wellhead housings with corresponding casing hangers for each wellhead housing. As a result, the casing hangers 16*a*, 18*a* installed in the wellhead housing 14 are typically manufactured by the same company since each manufacturer's wellheads and casing hangers are different from any other manufacturer.

Following the setting of the casing as shown in FIG. 1, a prior art tubing hanger assembly is typically run in the conventional well. Although not shown, a typical prior art tubing hanger assembly for a conventional well (i.e., a well in which the tubing hanger in landed in the wellhead housing) includes a housing having a string of production tubing extending from the housing substantially down to the production zone Z. A typical prior art tubing hanger installed in the wellhead housing of FIG. 1 lands on one or more shoulders 18*b* in the production casing hanger 18*a* and the weight of the suspended tubing string is supported by the production casing hanger 18*a*. Although not shown, the prior art production casing hanger 18*a* includes internal profiles, dimensions and details for landing, locking and sealing a typical prior art tubing hanger in the production casing hanger 18*a*. Similar to the above, each casing hanger manufacturer has its own proprietary configuration with respect to mating and connecting with the tubing hanger. As a result, in the typical conventional well, the tubing hanger is usually manufactured by the same manufacturer of the casing hanger(s) which is also typically the same as the wellhead housing manufacturer.

Referring still to FIG. 1, the BOP stack 20 is shown having the connector 20*a*, a vertical bore 20*b*, a plurality of rams 20*r*, a choke line 20*c* and a kill line 20*k*. There are several types and configurations of BOP stacks 20 that are suitable for use with the present invention. The present invention is not limited to the particular BOP stack 20 as shown in the figures. The bore 20*b* of the BOP stack 20 is shown with a diameter approximating the diameter of the wellhead housing 14. However, the BOP bore diameter needs only have a diameter the same as or slightly greater than the diameter of any tool or well component that must pass through the BOP stack 20 for the desired installation or work over operation. A work over is a term used when performing one or more of a variety of remedial operations on a producing well with the purpose of restoring or increasing production.

Although not necessary, it may be desirable to determine the distance between the top end 18*c* of the production casing hanger 18*a* and the upper face 14*a* of the wellhead housing 14. The depth of the top end 18*c* is typically determined from the known depth (dimensions) of the BOP stack 20. A typical wellhead housing 14 has approximately 24" to 36" between the housing upper face 14*a* and the top end 18*c* of the production casing hanger 18*a*.

Preferably, the length D between the top of one of the plurality of BOP rams 20*r*, for example ram 20*r'* in FIG. 1, and an inner face 20*f* of the BOP wellhead connector 20*a* is measured and known. This length D is referred to as the "space out" dimension for reasons which will be explained below. The inner face 20*f* of the wellhead connector 20*a* is typically adjacent to or abutting the upper face 14*a* of the wellhead housing 14 when the BOP stack 20 is mounted on the wellhead housing 14.

Figure 2:
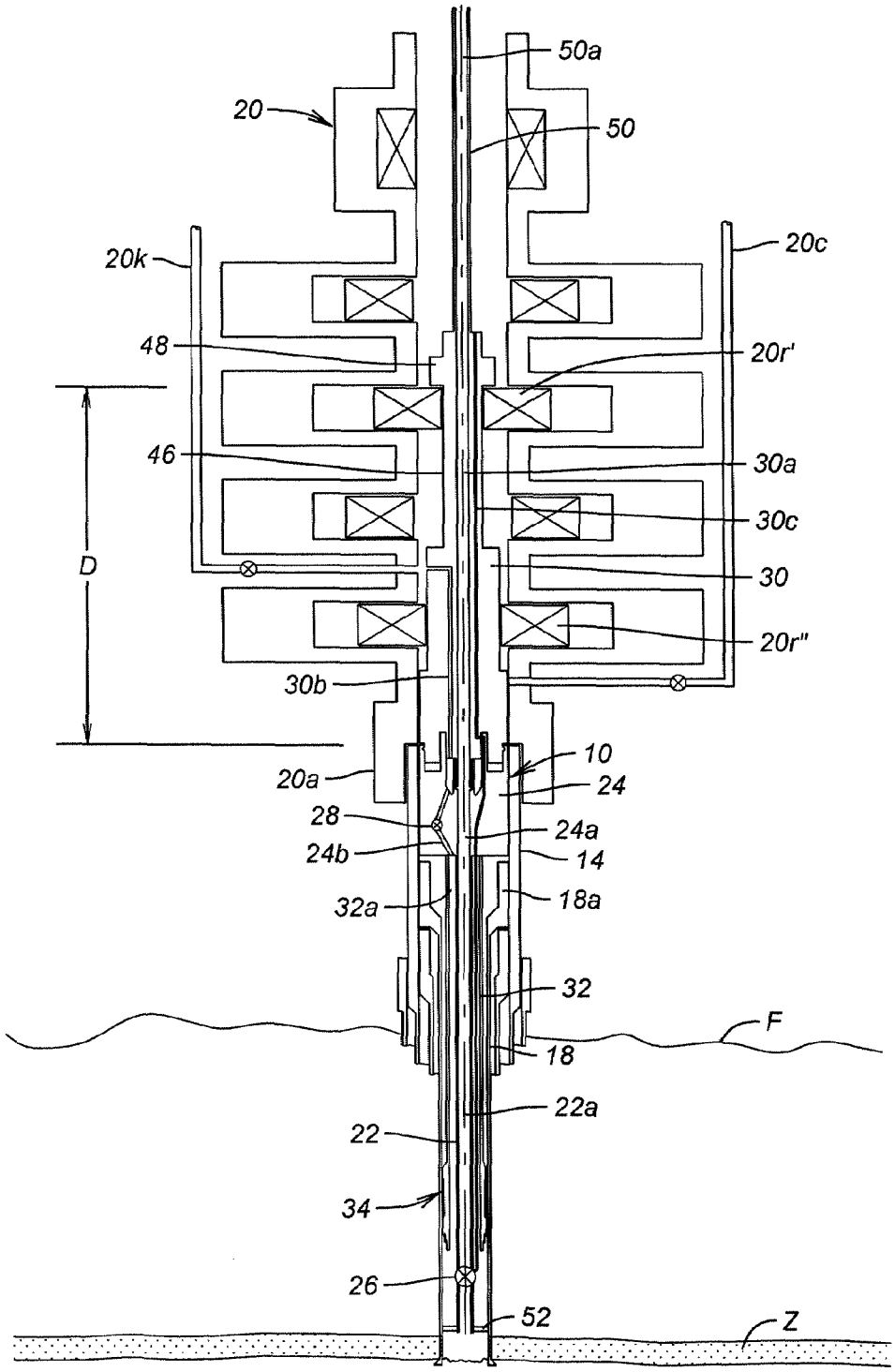
FIG. 2 is a schematic sectional elevation view showing a tubing hanger suspension assembly according to a preferred embodiment of the present invention lowered into a cased well bore and wellhead housing with a tubing hanger running tool.
Figure 2A:
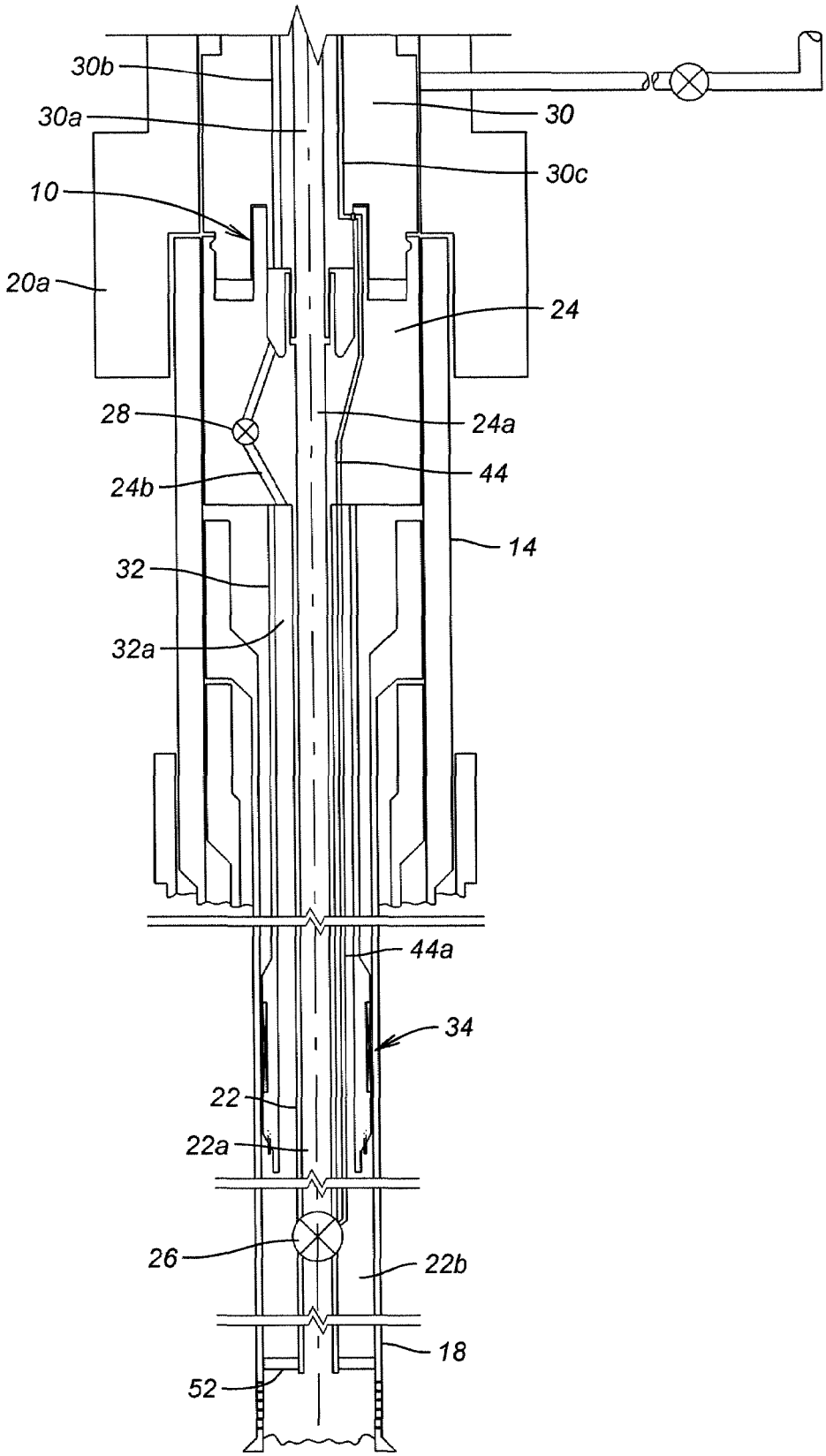
FIG. 2A is an enlarged view of the lower portion of FIG. 2.

A universal tubing hanger suspension assembly 10 according to a preferred embodiment of the present invention is shown in FIGS. 2 and 2A. The tubing hanger suspension assembly 10 includes a string of production tubing 22 connected to a tubing hanger housing 24. The production tubing 22 defines a production tubing bore 22*a* extending axially through the tubing 22. The tubing hanger housing 24 includes a production bore 24*a* in fluid communication with the production tubing bore 22*a*. The production bore 24*a* extends substantially vertically through the tubing hanger housing 24. As previously discussed, the production tubing string 22 typically extends down to the production zone Z. The production tubing string 22 may include a subsurface safety valve 26 at a desired depth within the well bore B.

The tubing hanger housing 24 also preferably includes an annulus passageway 24*b* extending through the tubing housing hanger 24. In the preferred embodiment, an annulus isolation valve 28 is included in the tubing hanger housing 24. The annulus isolation valve 28 is arranged and designed to seal and close off the annulus passageway 24*b*.

Referring to FIG. 2A, the universal tubing hanger suspension assembly 10 preferably includes a tubing hanger lower assembly 32 at a lower end of the tubing hanger housing 24. The lower assembly 32 may be connected to or integral with the tubing hanger housing 24. The lower assembly 32 preferably includes a sealing and lockdown assembly 34. The lower assembly 32 is preferably a tubular member having a throughbore. The tubular member 32 may be a pipe or a mandrel having a bore therethrough. The tubing hanger lower assembly 32 preferably extends around the production tubing string 22 with a production annulus 32*a* defined therebetween. While the production tubing string 22 preferably has a length such that its lower end extends approximately to the production zone Z, the tubing hanger lower assembly 32 preferably has a length substantially less than the length of the tubing string 22. Preferably, the length of the lower assembly 32 is less than 50% the length of the tubing string 22, more preferably less than 25% the length of the tubing string 22, and most preferably less than 15% the length of the tubing string 22.

Since the length of the tubing string 22 is dependent on the depth of the production zone Z, the length of the lower assembly 32 relative to the tubing string 22 varies from well to well. Preferably, the lower assembly 32 has a length in the range of 1' to 1,500', more preferably in the range of 1' to 300', and most preferably in the range of 5' to 100'.

Figure 3:
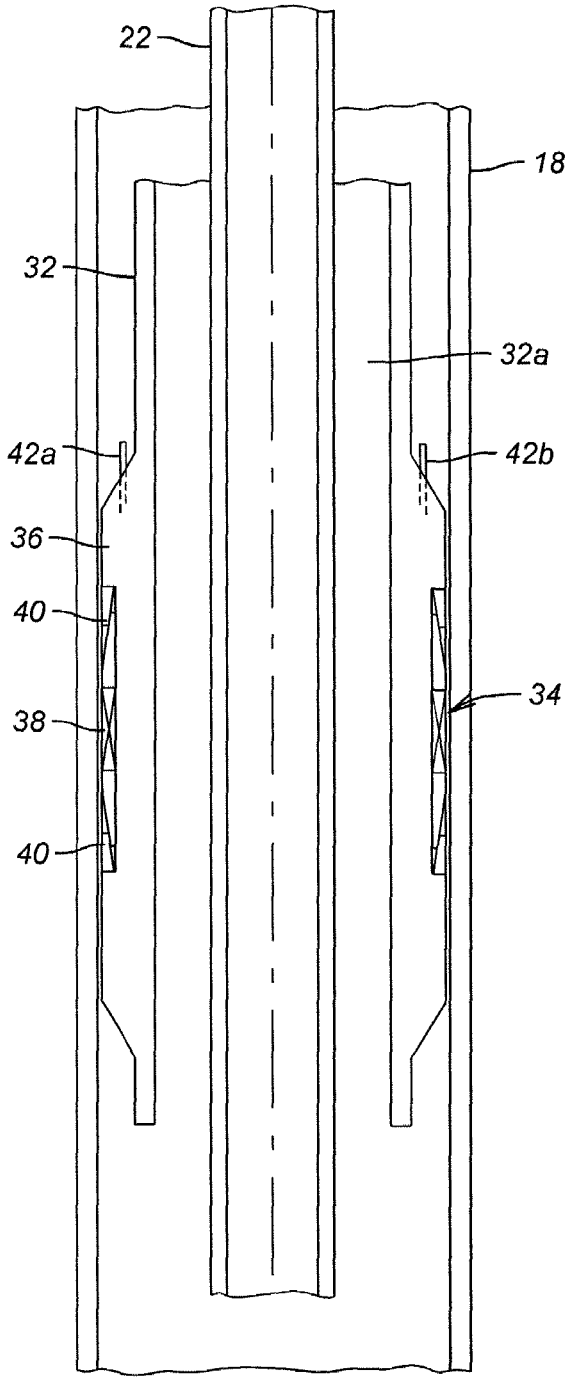
FIG. 3 is an enlarged schematic sectional elevation view of a preferred embodiment of the sealing and lockdown assembly of the tubing hanger suspension assembly of FIGS. 2 and 2A.

Preferably, the sealing and lockdown assembly 34 is carried by the tubing hanger lower member 32. Preferably, the sealing/lockdown assembly 34 is located near the lower end of the tubing hanger lower member 32. An enlarged view of the sealing/lockdown assembly 32 is shown in FIG. 3. Preferably, the sealing/lockdown assembly 34 includes an enlarged outside diameter tubular portion 36 which is slightly less than the inside diameter of the production casing 18. In the preferred embodiment, the sealing/lockdown assembly 34 includes a sealing apparatus 38 and a movement prevention locking apparatus or lockdown apparatus 40. It is to be understood that the sealing apparatus 38 and the lockdown apparatus 40 may be contained within a unitary assembly or may be separate assemblies. In wells having a subsurface safety valve 26, the sealing apparatus 38 will be positioned in the casing string 18 above the subsurface safety valve 26 and the lockdown apparatus 40 will also be above the subsurface safety valve.

In the preferred embodiment, the lockdown apparatus 40 includes elements or slips, which may be metallic or non-metallic, adapted to engage the interior of the production casing 18. When engaged, the lockdown apparatus 40 engages the interior of the casing 18 and "fixes" or prevents vertical movement of the tubing hanger suspension assembly 10 relative to the production casing 18.

The sealing apparatus 38 includes a sealing element, which may be made of elastomerics or other materials (including composites) or a metal seal, adapted to form an annular seal between the production casing 18 and the tubular portion 36, as for example, by compression. The sealing apparatus 38 and the lockdown apparatus 40 may be independently activated or jointly activated. Preferably, the activation and de-activation of the lockdown apparatus 40 and the sealing apparatus 38 is hydraulically controlled through ports 42*a* and 42*b* as will be explained below. The activation and de-activation may also be electronically, mechanically, or electrically activated or de-activated.

As shown in FIG. 2A, preferably one or more hydraulic control lines 44 extend through the tubing hanger housing 24 to provide hydraulic control to devices below the tubing hanger housing 24. For example, hydraulic control lines may be required to activate and de-activate the sealing apparatus 38 and the lockdown apparatus 40. Also, a hydraulic control line 44*a* may be required to run to the subsurface safety valve 26. Preferably, these hydraulic control lines 44 are run in the production annulus 32*a* between the lower member 32 and the production tubing string 22 as shown in FIG. 2A. The subsurface safety valve hydraulic control line 44*a* is preferably in a production tubing annulus 22*b* between the production casing string 18 and the production tubing string 22 below the lower end of the sealing and lockdown assembly 34 as shown in FIG. 2A.

Referring again to FIGS. 2 and 2A, the tubing hanger suspension assembly 10 is preferably lowered into the cased well bore B and wellhead housing 14 with a tubing hanger running tool 30. The tubing hanger running tool 30 is adapted to lock into the upper end of the tubing hanger housing 24. The tubing hanger running tool 30 preferably includes a production bore 30*a* which extends through the running tool 30 and communicates with the tubing hanger production bore 24*a*. The tubing hanger running tool 30 also preferably includes an annulus access bore 30*b* which communicates with the tubing hanger annulus passageway 24*b* and hydraulic lines 30*c* communicating with the hydraulic lines 44 of the tubing hanger housing 24. It is to be understood that the tubing hanger running tool 30 preferably includes lines for downhole hydraulics and chemical injection for communication with similar lines in the tubing hanger housing 24.

Referring to FIG. 2, the tubing hanger running tool 30 preferably includes an upper mandrel 46 having a space out mandrel adjust nut 48 or similar mechanism at an upper portion. Preferably, the nut 48 or the mandrel 46 and nut 48 are adjustable in length for reasons as explained below. As explained above with reference to FIG. 1, the space out dimension D is the measured and known distance between the top of BOP rams 20*r'* and the inner face 20*f* of the wellhead connector 20*a* of the BOP stack 20. This space out distance D is constant for the BOP stack 20 and is preferably measured before lowering the BOP stack 20 into the water. As shown in FIG. 1, the space out distance D also corresponds to the distance between the top of the BOP rams 20*r*' and the upper face 14*a* of the wellhead housing 14 when the BOP stack 20 is connected to the wellhead housing 14.

Referring to FIG. 2, the adjust nut 48 and the upper mandrel 46 of the tubing hanger running tool 30 are preferably "adjusted" before commencing the "running" or installation operations of the tubing hanger suspension assembly 10. The mandrel 46 and adjust nut 48 are adjusted such that the tubing hanger housing 24 is received at the desired elevation in the wellhead housing 14 when the adjust nut 48 contacts the partially closed BOP rams 20*r*' as shown in FIG. 2. The adjust nut 48 in the preferred embodiment has an outer diameter greater than the outer diameter of the upper mandrel 46. As the tubing hanger suspension assembly 10 approaches its desired depth, the larger diameter adjust nut 48 "bottoms out" on the rams 20*r*' which are closed to a diameter smaller than the diameter of the adjust nut 48 but larger than the mandrel diameter.

Referring to FIGS. 2 and 2A, the preferred installation operation of the tubing hanger suspension assembly 10 includes the lowering, through a riser (not shown) and BOP stack 20, of the production tubing string 22, the sealing and lockdown assembly 34, the tubing hanger lower tubular member 32, and the tubing hanger housing 24 with the tubing hanger running tool 30 and an installation tubing string 50, preferably drill pipe. The BOP rams 20*r*' are partially closed after the tubing hanger housing 24 and lower portion of the tubing hanger running tool 30 passes. With the rams 20*r*' closed or partially closed against the upper mandrel 46, the lowering operation continues until the adjust nut 48 contacts the rams 20*r*' and stops the tubing hanger running tool 30 at the predetermined distance. The predetermined distance properly positions the tubing hanger housing 24 at a prescribed elevation relative to the wellhead housing 14. In the preferred embodiment of the invention, the predetermined distance properly positions the tubing hanger housing 24 within the wellhead housing 14. For example, the predetermined distance may locate the upper end of the tubing hanger housing 24 within an inch or two above or below the top surface of the wellhead housing 14. With the adjust nut 48 contacting the rams 20*r*', the tubing hanger lower tubular member 32 and the sealing and lockdown assembly 34 are vertically held in position in the production casing string 18.

With reference again to FIG. 2, preferably a well completion fluid is circulated in the well. Preferably, the BOP rams 20*r*' are sealed around the upper mandrel 46. The well completion fluid is pumped from the rig down the kill line 20*k* of the BOP stack 20 and into the tubing hanger running tool annulus access bore 30*b*, the tubing hanger annulus passageway 24*b*, the lower member production annulus 32*a* and the production tubing annulus 22*b* and returned to the surface up through the production tubing bore 22*a*, tubing hanger production bore 24*a*, running tool production bore 30*a* and bore 50*a* of the installation tubing string 50. Alternatively, the completion fluid can be pumped down the installation tubing string bore 50*a*, the running tool production bore 30*a*, the tubing hanger and production string bores 24*a* and 22*a* and around the lower production packer 52 and up the annulus bores 22*b*, 32*a* to the tubing hanger annulus passageway 24*b*, the running tool annulus bore 30*b* and to the surface through the BOP choke or kill lines 20*c*, 20*k*. Preferably, the completion fluid is circulated in the well prior to the lower packer 52 being set to form a seal between the production casing 18 and the production tubing 22 at the lower end of the well. It is to be understood that the above circulations of completion fluid can be conducted either prior to or after setting the sealing apparatus 38.

The sealing and lockdown assembly 34 is activated, preferably hydraulically, via the hydraulic control lines to force the lockdown apparatus 40 into tight locked engagement with the production casing 18. Preferably, the engaged lockdown apparatus 40 prevents or substantially prevents relative vertical movement between the lower tubular member 32 and the production casing 18. Upon activation of the sealing apparatus 38, the sealing apparatus 38 forms a fluid- or gas-tight seal between the lower tubular member 32 and the production casing 18. The sealing and lockdown assembly 34 may comprise a set of slips having metal elements which grip the production casing 18. An elastomeric or other seal is preferably compressed by the set slips to form the fluid-tight seal. Preferably, the sealing and lockdown assembly 34 is a modified packer assembly of the type conventionally used in wells to isolate production zones, etc. Such representative packer assembly technology is generally described in U.S. Pat. Nos. 6,769,491; 5,988,276; 5,271,468; and 4,296,806, and commercially available from companies such as Halliburton Company, Baker Hughes Inc. and Weatherford/Lamb, Inc. Applicant incorporates by reference herein U.S. Pat. Nos. 6,769,491; 5,988,276; 5,271,468; and 4,296,806 in their entirety.

In this preferred embodiment of the present invention, the sealing and lockdown assembly 34 engaged with the production casing 18 provides the sealing and load support of the universal tubing hanger suspension assembly 10 in the well. The sealing and lockdown assembly 34 provides vertical load support to support the universal tubing hanger assembly 10 and to resist upward forces that may be exerted against the assembly 10. This sealing, locking and suspension of the tubing hanger assembly 10 is accomplished and installed independently of any critical and proprietary dimensions in the wellhead housing 14 and/or casing hangers 16*a*, 18*a*. Furthermore, in this preferred embodiment the tubing hanger housing 24 is not required to, and preferably does not, lock or seal with either the wellhead housing 14 or the casing hangers 16*a*, 18*a*.

With the sealing and lockdown assembly 34 activated and set, the seal may be pressure tested from above or below the sealing and lockdown assembly 34. The seal can be pressure tested from above by closing the annulus isolation valve 28 in the tubing hanger housing 24 and with the rams 20*r*' sealed around the upper mandrel 46, pumping a fluid from the surface through the kill line 20*k*, down past open ram 20*r*", around the outside of the tubing hanger running tool 30 within the BOP bore 20*b*, in the annular area between the wellhead housing 14 and the tubing hanger housing 24, and the annular area between the production casing 18 and the lower member 32.

Preferably, after the sealing and lockdown assembly 34 has been successfully tested, the lower packer 52 is set to seal off the production tubing annulus 22*b* proximal to the bottom of the production tubing string 22. The lower packer 52 can be tested from below by opening the annulus isolation valve 28 and closing the BOP rams 20*r*' and lower rams 20*r*" around the tubing hanger running tool 30. To pressure test, pressure is built up by pumping fluid down the installation tubing string bore 50*a*, the tubing hanger running tool production bore 30*a*, the tubing hanger production bore 24*a* and the production tubing bore 22*a* to beneath the packer 52. If, during the test, the packer 52 leaks fluid, pressure and fluid is taken up through the tubing annulus 22*b*, annulus valve 28 and annulus passageway 24*b*, between rams 20*r*' and 20*r*", and up the kill line 20*k*.

Figure 4:
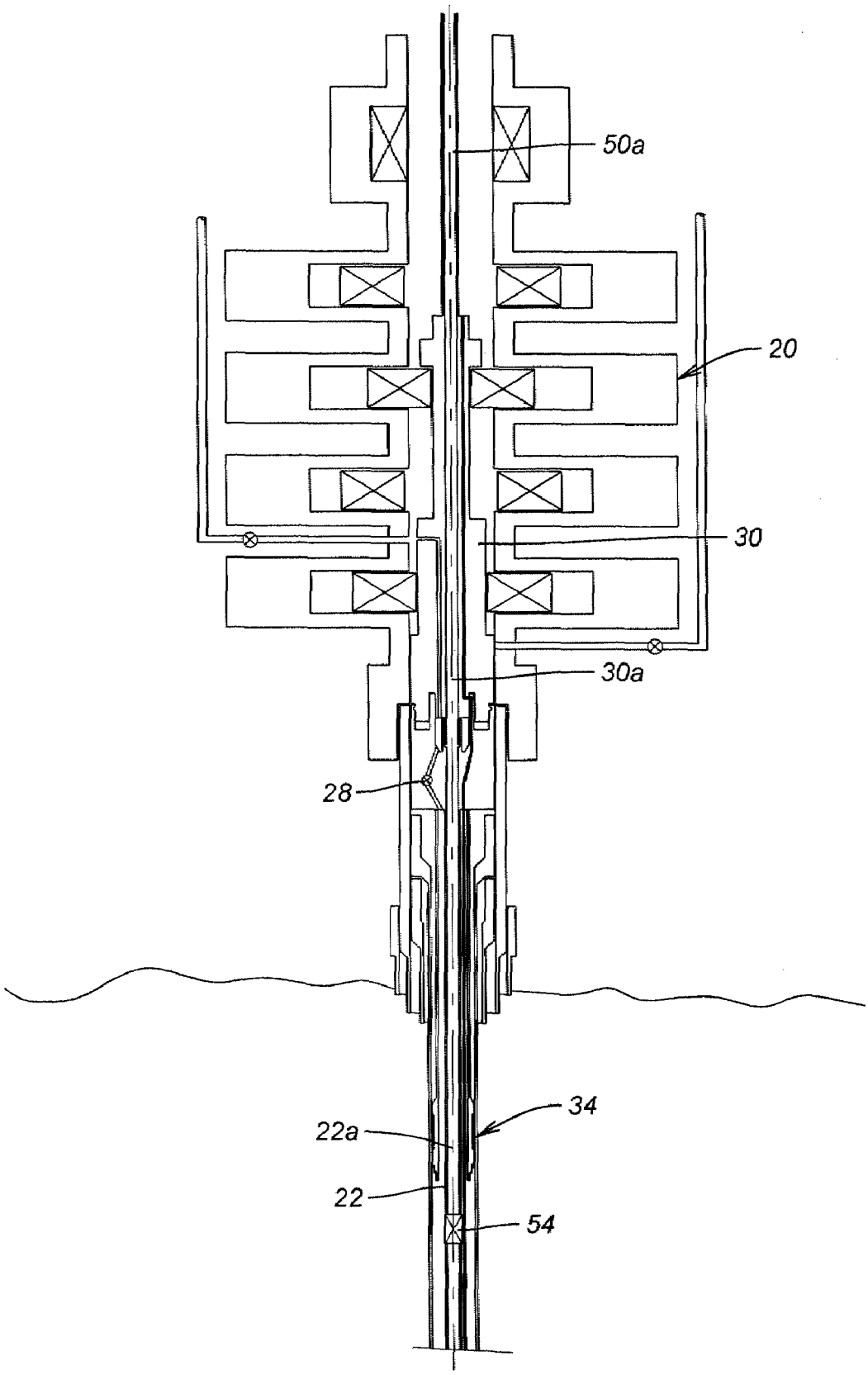
FIG. 4 is a view similar to FIG. 2 with the sealing and lockdown assembly set in the casing string and a retrievable plug set in the production tubing.

With reference to FIG. 4, preferably a closure member or plug 54 is lowered (e.g., via wireline) down the installation tubing string bore 50*a* and tubing hanger production bore 30*a* and set in the bore 22*a* of the production tubing 22. The closure member 54 is preferably a retrievable plug, and more preferably a wireline retrievable plug. In the preferred embodiment the closure member 54 is set in the production tubing 22 at a depth at or below the sealing and lockdown assembly 34. Alternatively, the closure member 54 may be set in the production tubing 22 at or above the sealing and lockdown assembly 34 or in the tubing hanger housing production bore 24*a*.

After setting and testing the sealing and lockdown assembly 34, the lower packer 52 and the closure member 54, and with the subsurface safety valve 26 and the annulus isolation valve 28 closed, the tubing hanger running tool 30 is disconnected from the tubing hanger housing 24 and retrieved to the surface. The BOP stack 20 is then removed from the wellhead housing 14.

Figure 5:
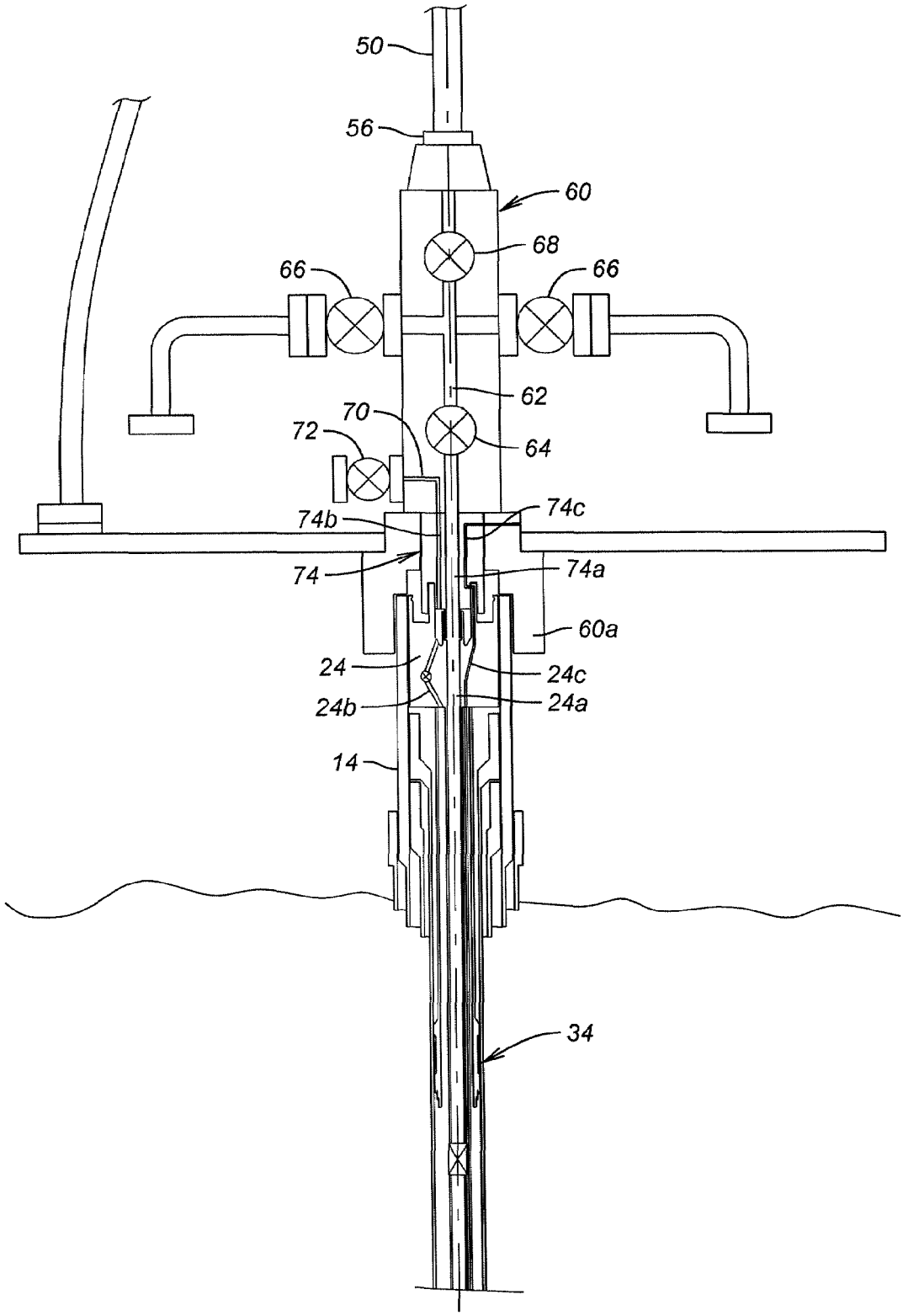
FIG. 5 is a schematic sectional elevation view showing a preferred embodiment of a subsea tree with a stab sub connected to the universal tubing hanger suspension assembly and wellhead housing.

Next, a tree assembly 60 is lowered from the upper surface of the water via a pipe string 50, preferably a drill string, and a tree running tool 56 as shown in FIG. 5. The tree assembly 60 is shown having a production bore 62, production master valve 64, production wing valves 66 and a production swab valve 68. The tree assembly 60 also includes an annulus bore 70 and an annulus master valve 72. The tree assembly 60 has a tree wellhead connector 60*a* adapted to seal and connect with the wellhead housing 14.

The preferred tree assembly 60 shown in FIG. 5 is generally referred to as a monobore tree; however, the present invention is applicable not only to monobore trees but also dual bore and multi-bore trees and test trees. Additionally, while the present invention is particularly suited for subsea application, it could also be used for surface applications.

FIG. 5 shows the tree assembly 60 with a tree-to-tubing hanger stab sub assembly 74 providing various interconnections between the tree assembly 60 and the universal tubing hanger suspension assembly 10. The stab sub assembly 74 is preferably installed in the lower end of the tree assembly 60 before lowering the tree assembly 60 to the wellhead housing 14. The stab sub assembly 74 includes a production bore 74*a* in sealed engagement with the tree production bore 62 and forms a sealed engagement with the tubing hanger housing production bore 24*a* upon the installation of the tree assembly 60 on the wellhead housing 14. Similarly, the stab sub assembly 74 also includes an annulus bore 74*b* in sealed engagement with the tree annulus bore 70. The annulus bore 74*b* forms a sealed engagement with the tubing hanger annulus bore 24*b* upon the installation of the tree assembly 60. One or more hydraulic control lines 74*c* are preferably in the stab sub assembly 74 and provide connection to hydraulic lines 24*c*, 44*a* and 44*b* (FIG. 9) for the control of downhole equipment and devices. Additionally, other ports or lines, such as a chemical injection line, may be provided in the stab sub assembly 74. It is to be understood that the use of "lines" in reference to the hydraulics and chemical injection is meant to include either tubing or bores or ports in solid members, as for example the tubing hanger housing 24 or stab sub assembly 74.

Figure 7:
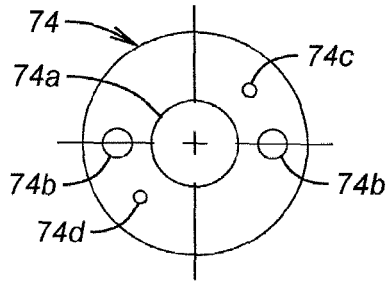
FIG. 7 is a section view of the stab sub taken along lines 7-7 of FIG. 6.
Figure 6:
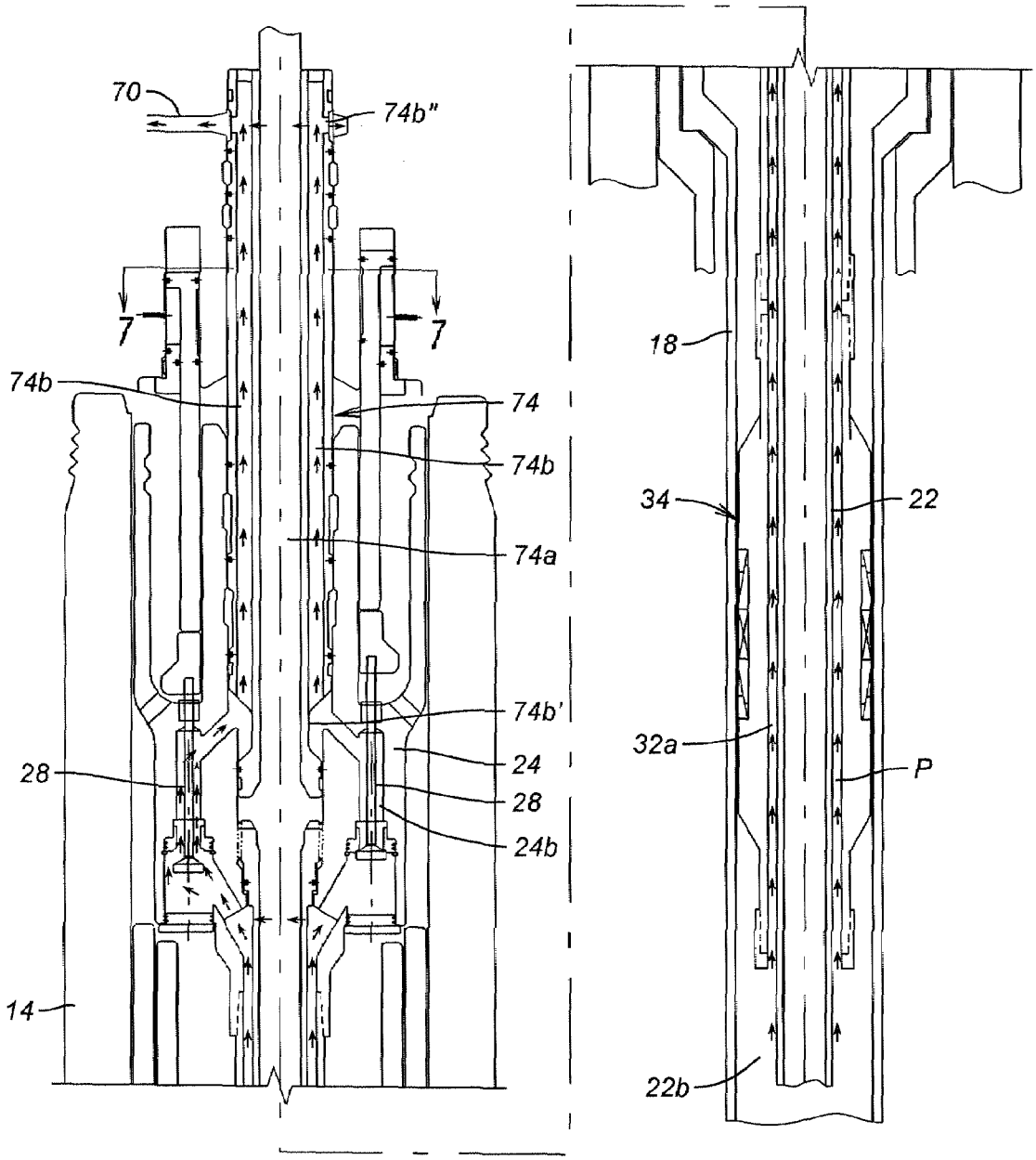
FIG. 6 is a sectional elevation view of the stab sub connected to the universal tubing hanger assembly according to a preferred embodiment of the present invention, the arrows indicating an annulus flowpath.

FIG. 6 shows a preferred embodiment of the stab sub 74 connected to the universal tubing hanger housing 24. A pair of annulus isolation valves 28 are shown in the tubing hanger housing 24. The right side of FIG. 6 shows the right valve 28 in the closed position to close the annulus passageway 24*b*, and the left side shows the left valve 28 in the open position to open the annulus passageway 24*b*. It is to be understood that preferably the left and right isolation valves 28 assume the same position and are operated together. As shown in FIGS. 6 and 7, the stab sub 74 preferably includes a pair of annulus bores 74*b* in order to provide a sufficient cross sectional annular flow area, typically the combined area being equivalent to the cross sectional area of a 1.5" to 2" diameter hole. The lower ends of the annulus bores 74*b* are in fluid communication with each other by a peripheral groove or gallery 74*b*'. Similarly, the upper ends of the annulus bores 74*b* are in fluid communication with each other by a peripheral groove or gallery 74*b*". Alternatively or additionally, the tree assembly 60 may also include a peripheral groove for providing fluid communication to the tree annulus bore 70 and the annulus master valve 72 (FIG. 5). The annulus flowpath P from below the sealing and lockdown assembly 34 to the tree assembly 60 with the annulus isolation valve 28 open is indicated by the arrows in FIG. 6.

Figure 8:
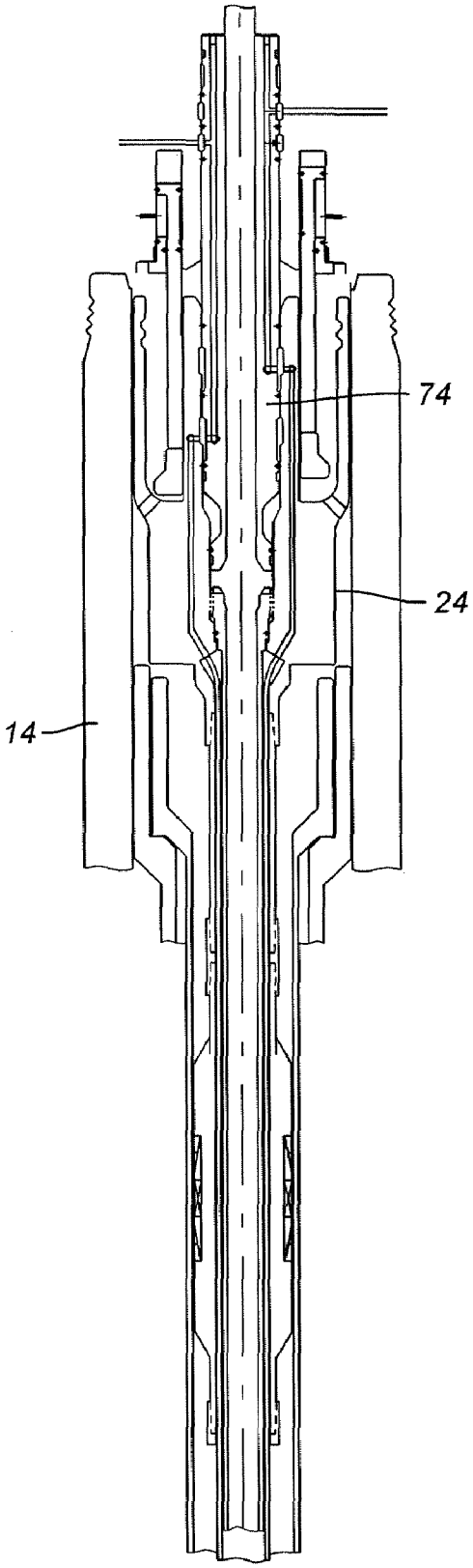
FIG. 8 is a view similar to FIG. 6 showing passageways for the chemical injection and subsurface safety valve controls.
Figure 9:
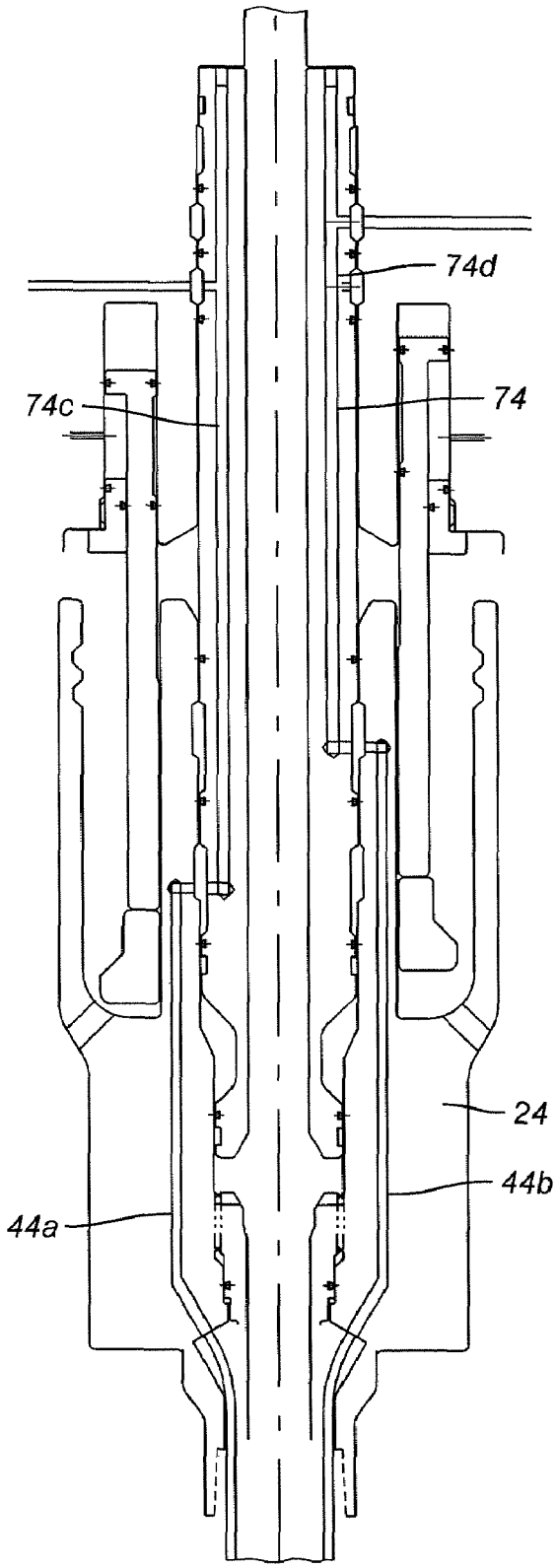
FIG. 9 is an enlarged view of the upper portion of FIG. 8.

FIGS. 8 and 9 show passageways for the chemical injection and hydraulic or subsurface safety valve (SSSV) controls. The section views of FIGS. 8 and 9 have been angularly rotated relative to the section view of FIG. 6. As shown in FIG. 9, the stab sub 74 includes separated passageways for the hydraulic controls 74*c* for the subsurface safety valve 26 and for chemical injection 74*d*. Similar galleries as described above are preferably provided for each. It is to be understood that seals are preferably provided between each of the galleries to maintain segregation between the various passageways.

In the preferred embodiment, the widths (measured along the longitudinal axis of the stab sub 74) of the peripheral grooves or galleries are larger than the respective diameters of the bores 74*b*, 74*c* and 74*d* to allow communication between the respective passageways over a range of vertical spacing variations between the tubing hanger housing 24 and the tree assembly 60. For example, the vertical elevation of the tubing hanger housing 24 relative to the wellhead housing upper face 14*a* is predetermined and set via the running tool upper mandrel 46 and adjust nut 48 as described above. The tree assembly 60 is installed on the wellhead housing 14. The stab sub 74 provides the fluids and controls linkage between the tubing hanger housing 24 and the tree assembly 60. Since the stab sub 74 is preferably joined to the tree assembly 60 prior to lowering the assembly, it is important that all of the fluids/controls connections between the tubing hanger housing 24 and the stab sub 74 automatically mate when the tree assembly 60 is secured to the wellhead housing 14. The enlarged widths of the peripheral grooves or galleries described above permits the desired mating over a range of distances between the tree assembly 60 and the tubing hanger housing 24. Preferably, the galleries allow the stab sub 74 to properly mate and communicate over a vertical distance range of approximately 1" to 3".

The galleries, as described above with respect to the preferred embodiment, allow the tree assembly 60, the stab sub 72 and the tubing hanger housing 24 to communicate and mate with each other independently of the angular orientation of the separate components. This is referred to as being "non-oriented" which simplifies the running and installation of the subsea components. It is to be understood that the invention may also be used with oriented subsea components.

With the tree assembly 60 secured and tested, the closure member 54 is retrieved to the surface through the bores of the production tubing 22, tubing hanger 24, stab sub assembly 74, Christmas tree assembly 60, tree running tool 56 and the installation tubing string 50.

Figure 10:
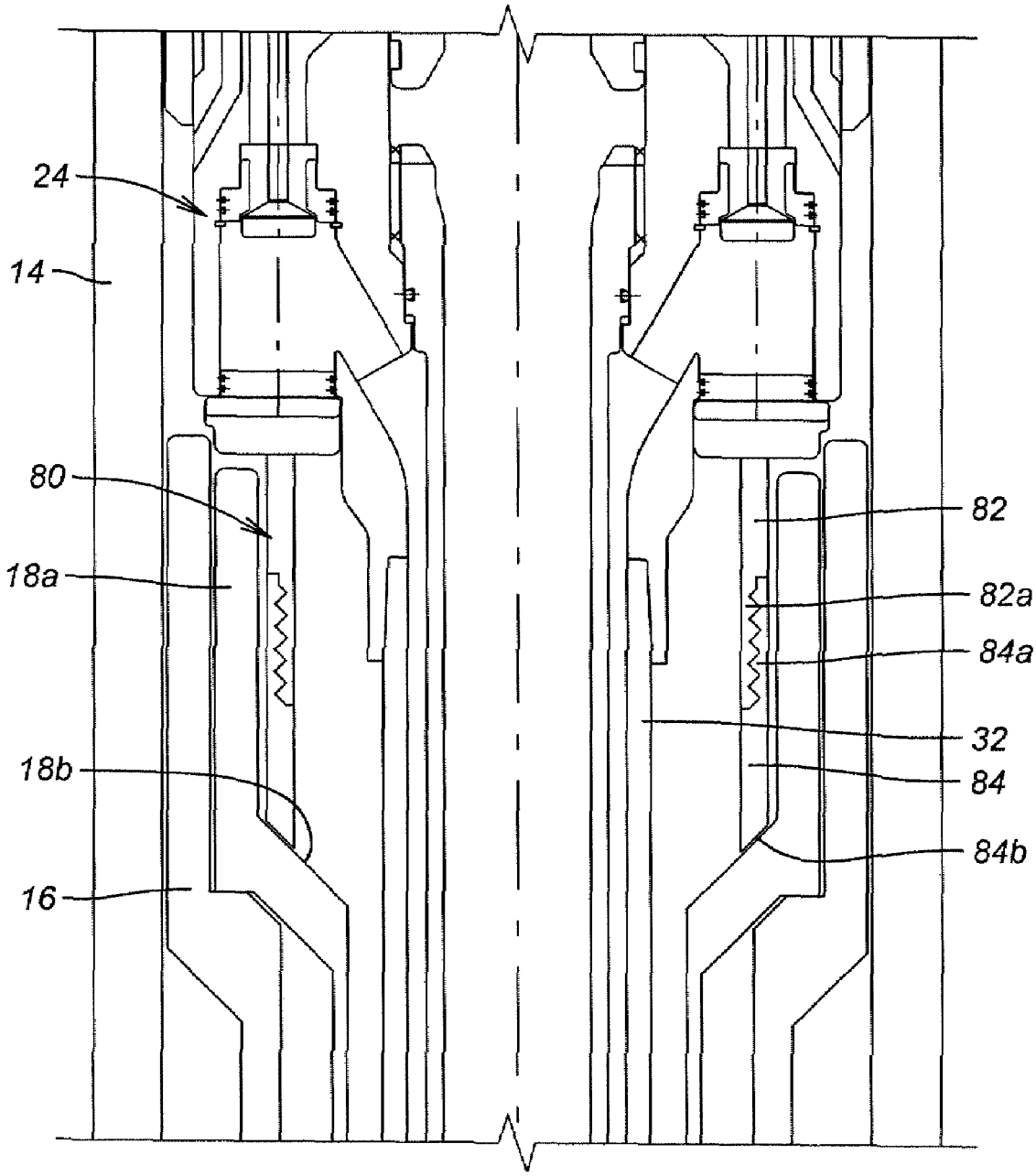
FIG. 10 is a sectional elevation view of a portion of the tubing hanger suspension assembly according to another embodiment of the present invention.

FIG. 10 shows a slight modification to the embodiment of the present invention shown and described above. In FIG. 10, a stop apparatus 80 has been connected to the lower end of the tubing hanger housing 24. The stop apparatus 80 is preferably a ring member having an upper ring portion 82 and a lower ring portion 84. Each ring portion 82, 84 includes a threaded end 82*a*, 84*a*, respectively, adapted to engage each other. Preferably, the lower ring portion 84 has a lower beveled end 84*b* corresponding to the shoulder 18*b* in the production casing hanger 18*a*. Preferably, the length of the stop apparatus 80 can be adjusted by the threaded engagement of the ring portions 82 and 84 prior to installing the tubing hanger suspension assembly 10. Preferably, the length of the stop apparatus 80 is such that the lower beveled end 84*b* contacts the casing hanger shoulder 18*b* and transfers the weight of the tubing hanger suspension assembly 10 to the production casing hanger 18*a*. Thus, if the dimensions and location of the production casing hanger 18*a* relative to the wellhead housing 14 are known, the ring stop apparatus 80 may be employed to provide a downward stop when lowering and installing the tubing hanger suspension assembly 10. Furthermore, the ring stop apparatus 80 can be used in lieu of the adjust nut 48. It is to be understood that ring stop apparatus 80 does not provide a seal, nor does it provide resistance to upward forces—the seal and resistance to upward forces are still provided by the sealing and lockdown assembly 34.

Based upon the foregoing description of the present invention, a "universal" set of subsea well components is achievable. For example, a common size of wellhead housing 14 has an inside diameter (ID) of 18.625" or 18.75", depending on the manufacturer. The casing hangers installed in these wellhead housings 14 are typically 24" to 36" below the upper face of the wellhead housing. Thus, the tubing hanger housing 24 of the universal tubing hanger suspension assembly 10 can occupy a round cylindrical space of approximately 18.5" in diameter and 24" in height at the upper portion of the wellhead housing 14. Since the preferred tubing hanger housing 24 does not include a releasable locking mechanism for locking to the upper portion of the wellhead housing 14 (typical of conventional tubing hangers), the 18.5" diameter is substantially fully usable by the tubing hanger housing 24. This is a substantial benefit of the present invention because the "usable space" for the various bores and passageways required to pass through the tubing hanger housing is substantially greater than in conventional tubing hangers.

Preferably, the length of the stab sub assembly 74 is the same regardless of the type of wellhead housing 14 and casing hangers 16*a*, 18*a* on which the tree assembly 60 is being installed. This is accomplished due to using the space out dimension D to substantially uniformly position the tubing hanger 24 relative to the top of the wellhead housing 14 regardless of the wellhead housing type. This provides simplicity in design from wellhead to wellhead and allows for a "universal" stab sub assembly 74 used with the preferred tree assembly 60. Certainly, separate stab sub assemblies are required for different size production tubing.

Thus, it is to be understood that the universal tubing hanger suspension assembly 10, the stab sub 74 and the tree assembly 60 are capable of installation on various wellhead housings 14, and are, to a great degree, "universal" and "off the shelf" items, eliminating significant engineering and fabrication costs incurred when installing Manufacturer A's tree assembly on Manufacturer B's wellhead housing. The present invention also eliminates the use of a tubing spool (wellhead connector and crossover wellhead housing) mounted to Manufacturer B's wellhead housing for carrying Manufacturer A's tubing hanger.

In the preferred embodiment of the present invention, the universal tubing hanger suspension assembly 10, the stab sub assembly 74 and the tree assembly 60 do not require angular orientation which significantly simplifies the installation procedure. However, it is to be understood that the present invention is not limited to non-orientation and may also be used with components requiring orientation with respect to each other. Techniques for orienting a tree assembly to a tubing hanger are well known in the art. One type of suitable orientation technique is disclosed in U.S. Pat. No. 5,544,707 and is hereby incorporated by reference. Another orientation technique is to modify the BOP stack 20 with a pin to orient the components as they pass through the BOP stack 20. Orientation of the components adds costs and complexity to the subsea installation process.

The present invention includes a tubing hanger suspension assembly 10 for an oil and gas well and a method of installing same. The tubing hanger suspension assembly 10 includes a tubing hanger housing 24 which is positioned in the wellhead housing 14. The tubing hanger assembly 10 includes a sealing and lockdown mechanism 34 capable of providing sealing and load support of the production tubing 22 in the production casing string 18. A stab sub assembly 74 connected to the upper end of the tubing hanger suspension assembly 10 and lower end of the Christmas tree assembly 60 provides downhole hydraulic and electric functionality and annulus access to the production tubing 22.

Using the BOP stack 20 for space out and placement of the tubing hanger suspension assembly 10 negates the need for exact dimensions of the wellhead housing 14 for space out and also negates the need for any internal stack up dimensions to interface the subsea tree assembly 60 to the stab sub assembly 74. Preferably, space out of the tubing hanger assembly 10 is accomplished through an adjustable space out nut 48 at the top of the upper mandrel 46 of the running tool 30 in the BOP stack 20. Alternatively, the space out predetermined elevation of the tubing hanger assembly 10 can be accomplished using a ring stop apparatus 80, preferably adjustable, landing in the production casing hanger 18. Using tubing packer technology for fixing the lower member elevation at a predetermined elevation through the BOP stack 20 rather than the wellhead housing 14 allows subsea tree interface in any industry wellhead system. The device or devices used in the system negates the use of the BOP stack 20 or the wellhead for orientation as well.

The apparatus and methods described above are advantageous because they are suitable for use in wellhead housings 14 independent of proprietary details pertaining to the housing. The tubing hanger suspension assembly 10 of the preferred embodiment of the present invention eliminates the need to use wellhead housing or casing hanger landing shoulders for locking and sealing the tubing hanger housing 24 in position. The tubing hanger suspension assembly 10 of the preferred embodiment of the present invention eliminates the need to seal the tubing hanger housing 24 to the wellhead housing 14. The preferred embodiment eliminates these requirements by sealing, anchoring and locking the sealing and lockdown assembly 34 in the production casing 18 suspended by the casing hanger 18*a* in the wellhead housing or system.

The present invention provides simplicity and reduced costs in completing a subsea well. The tubing hanger housing 24 is preferably not locked to, sealed with, or supported by the wellhead housing 14. Thus, the wellhead housing 14 no longer needs the details, profiles, etc. related specifically to the tubing hanger housing 24. Furthermore, no internal profiles, etc. are required in the production casing string 18 for cooperating with the sealing and lockdown assembly 34. This provides flexibility to install the tubing hanger housing 24 at the desired elevation for ensuring the proper spacing to be bridged by the stab sub assembly 74 as it is lowered with the tree assembly 60. Even the final elevation of the sealing and lockdown assembly 34 in the casing string 18 can be varied over a substantial distance by changing the length of the lower member 32. It is also to be understood that depending on various well related factors, the present invention could employ a plurality of sealing and lockdown assemblies 34 if deemed desirable.

It is also to be understood that the present invention provides a substantial amount of additional cross sectional area available for use in the tubing hanger housing 24 which is a tremendous benefit. The tubing hanger housing 24 may have a diameter that approaches the inside diameter of the wellhead housing 14. The additional area allows ample space for an increased production bore or multiple production bores, annulus and various other ports and controls, etc. that are required or desired in a tubing hanger housing.

A description of some of the benefits derived from the preferred embodiment of the tubing hanger suspension assembly of the present invention follow:

For the customer/user, the wellhead becomes invisible to the completion. This provides savings to the user in two ways: engineering and hardware interfacing. Engineering is reduced in determining tubing hanger interfaces such as stack up tolerances and dimensions and compatibility issues. Currently, this includes issues in subsea and surface completions.

Engineering:

1. Engineering time spent on interface is significant. Users spend approximately one man week on engineering the interface for their completion. This generally requires 2 engineers at a cost of $200 per/hour totaling $16,000 per manufacturer's interface. The cost for two wells is approximately $32,000 and for ten wells is $320,000.
2. A manufacturer supplying proprietary drawings to work the interface issues charges $10,000 for each drawing. Typically, a minimum of two drawings are required totaling $20,000. This is charged on a well by well basis even if the wells are identical and drawings are copied. If the user has two wells, the charge is $40,000 or if he has ten wells the charge is $200,000. The wellhead manufacturer charges these fees for access to its needed proprietary information which serves as a monetary incentive to the user to purchase the wellhead manufacturer's tubing hanger and Christmas tree as opposed to seeking the most economical/commercial solution to his subsea well completion.
3. This totals between $36,000 for one well and $520,000 for ten wells.

Manufacturing and hardware interfaces:

1. To complete a well using conventional tubing suspension methods inside a wellhead where the wellhead is of a different manufacturer than the tree, the tree manufacturer's conventional tubing suspension system is not compatible with the wellhead, therefore the user's completion is rendered useless. This means the user's $1,300,000 to $2,000,000 completion is useless and he must purchase other tree at the cost of time, schedule and hardware.
2. If the well situation will allow the technical deficit, a crossover spool may be used, however, the same issues as expressed above in Engineering are incurred. The crossover spool is mounted on the wellhead housing and is designed to accommodate the tubing hanger of the tree manufacturer. In addition to the added engineering cost, the hardware cost for the crossover is approximately $500,000 with approximately an additional $1,500,000 to $7,000,000 in installation spread cost. This spread cost is dependent on water depth and geographic location.
3. Horizontal trees have been used to assist in this respect. In a horizontal tree, the tubing hanger housing is landed and sealed in the tree (spool) as opposed to the wellhead housing. However, horizontal trees come with a price and engineering interface also. Typically, the horizontal tree is approximately $1,000,000 higher in cost as well as approximately $1,200,000 in ancillary tolling cost per well.
4. In the preferred embodiment of the tubing hanger suspension assembly of the present invention, the lockdown and sealing device is in the casing bore. This provides advantages in the following areas: cost and flexibility. Cost is reduced to the user because a single or multi-bore production tubing system can be used. This allows large stab subs to be used in the tree to bring multi-bores (production, annulus and hydraulic ports) through stab sub mandrels for tree interface, thus saving approximately $500,000 to $7,000,000 in the tree and completion.

It is to be understood that the present invention, including the universal tubing hanger suspension assembly 10, is not limited to the preferred embodiments described herein. The universal tubing hanger suspension assembly 10 is not limited to the tubing hanger housing being received in the wellhead housing. Rather, the universal tubing hanger suspension assembly 10 can also be used in wells in which the tubing hanger is received in tubing spools or horizontal trees mounted on the wellhead housing. It is to be understood that the sealing apparatus 38, and optionally the lockdown apparatus 40, would still be positioned in the casing string 18.

Preferred embodiments of the tubing hanger suspension assembly, well completion system and method of installing same according to the present invention have thus been set forth. However, the invention should not be unduly limited to the foregoing, which has been set forth for illustrative purposes only. Various modifications and alterations of the invention will be apparent to those skilled in the art, without departing from the true scope of the invention.

I claim:

1. In a well assembly having a wellhead housing (14) defining a wellhead bore, a production casing string (18) extending down a well bore (B) to a production zone and coupled to the wellhead housing, and a production tubing string (22) connected to a tubing hanger housing (24), the improvement comprising:

a lower assembly (32) coupled to a lower end of the tubing hanger housing and having a bore therethrough, the production tubing string extending through said lower assembly bore and defining a lower assembly production annulus (32*a*) between said lower assembly and the production tubing string, and said lower assembly including a movement prevention locking apparatus (40) locking said lower assembly to a non-profiled surface of the production casing string.

2. The well assembly of claim 1, wherein the tubing hanger housing (24) is solely vertically supported via said lower assembly (32).

3. The well assembly of claim 2, wherein the tubing hanger housing (24) vertical support is provided by the engagement of said movement prevention locking apparatus (40) with the production casing string (18).

4. The well assembly of claim 1, wherein said lower assembly (32) further comprises a sealing apparatus (38) forming a fluid-tight seal between said lower assembly and the production casing string.

5. The well assembly of claim 1, wherein said lower assembly (32) includes a lower member and said movement prevention locking apparatus (40) locks said lower member to the production casing string (18).

6. The well assembly of claim 1, wherein said lower assembly (32) includes a lower member and said movement prevention locking apparatus (40) has a locked condition and an unlocked condition, said locked condition includes locking said lower member to the production casing string (18).

7. The well assembly of claim 6, wherein said movement prevention locking apparatus (40) can be activated from said unlocked to locked condition and from said locked to unlocked condition.

8. The well assembly of claim 4, wherein said sealing apparatus (38) forms a fluid-tight seal between a lower member of said lower assembly and the production casing string (18).

9. The well assembly of claim 8, wherein said sealing apparatus (38) has a sealed condition and an unsealed condition, said sealing apparatus can be activated from said unsealed to sealed condition and from said sealed to unsealed condition.

10. The well assembly of claim 1, wherein said movement prevention locking apparatus (40) is arranged and designed for activation to extend radially outwardly from a lower member into locking engagement with the production casing string (18).

11. The well assembly of claim 10, wherein said lower member transfers the load of the tubing hanger housing (24) and the production tubing string (22) to the production casing string (18) independently of the production tubing string (22).

12. The well assembly of claim 6, wherein the tubing hanger housing (24) is positioned axially within the wellhead housing (14) so that when said movement prevention locking apparatus (40) is activated to said locked condition, the tubing hanger housing (24) and said lower member are supported axially solely by said movement prevention locking apparatus (40) in engagement with the production casing string (18).

13. The well assembly of claim 1, wherein the tubing hanger housing (24) is freestanding in the wellhead housing (14).

14. The well assembly of claims 1, wherein the tubing hanger housing (24) includes an annulus passageway (24*b*) in fluid communication with said lower assembly production annulus (32*a*).

15. The well assembly of claim 1, wherein the production tubing string has a tubing string length and said lower assembly (32) has a lower assembly length, and said lower assembly length is less than 50% of the tubing string length.

16. The well assembly of claim 1, wherein the production tubing string has a tubing string length and said lower assembly (32) has a lower assembly length, and said lower assembly length is less than 25% of the tubing string length.

17. The well assembly of claim 1, wherein the production tubing string has a tubing string length and said lower assembly (32) has a lower assembly length, and said lower assembly length is less than 15% of the tubing string length.

18. The well assembly of claim 1, wherein said lower assembly (32) has a length in the range of 1 foot to 1,500 feet.

19. The well assembly of claim 1, wherein said lower assembly (32) has a length in the range of 1 foot to 300 feet.

20. The well assembly of claim 1, wherein said lower assembly (32) has a length in the range of 5 feet to 100 feet.

21. The well assembly of claim 1, wherein the tubing hanger housing (24) is adapted for a range of vertical elevations relative to the wellhead housing (14).

22. The well assembly of claim 4, further comprising a second sealing apparatus and a second movement prevention locking apparatus on said lower assembly, said second sealing apparatus adapted to form a fluid-tight seal between said lower assembly and the production casing string, and said second movement prevention locking apparatus adapted to lock said lower assembly to the production casing string.

23. In a well assembly having a wellhead housing (14) defining a wellhead bore, a production casing string (18) extending down a well bore (B) and coupled to the wellhead housing, and a production tubing string (22) connected to a tubing hanger housing (24), the improvement comprising:

a lower assembly (32) coupled to a lower end of the tubing hanger housing and having a bore therethrough, the production tubing string extending through said lower assembly bore and defining a lower assembly production annulus (32*a*) between said lower assembly and the production tubing string, and said lower assembly including a movement prevention locking apparatus (40) locking said lower assembly to the production casing string, wherein a production casing hanger (18*a*) is coupled to the production casing string (18) and a stop apparatus (80) is attached to the tubing hanger housing (24), said stop apparatus cooperating with the casing hanger to limit downward movement of the tubing hanger housing.

24. The well assembly of claim 23, wherein said stop apparatus (80) is adjustable in length.

25. In a well assembly having a wellhead housing (14) defining a wellhead bore, a production casing string (18) extending down a well bore (B) and coupled to the wellhead housing, and a production tubing string (22) connected to a tubing hanger housing (24), the improvement comprising:

a lower assembly (32) coupled to a lower end of the tubing hanger housing and having a bore therethrough, the production tubing string extending through said lower assembly bore and defining a lower assembly production annulus (32*a*) between said lower assembly and the production tubing string, and said lower assembly including a movement prevention locking apparatus (40) locking said lower assembly to the production casing string;

the tubing hanger housing (24) having a production bore (24*a*) and an annulus bore (24*b*);

a tree assembly (60) having a production bore (62) and an annulus bore (70), said tree assembly mounting to the wellhead housing (14); and a stab sub assembly (74) having a first end connected to said tree assembly and a second end connected to the tubing hanger housing, said stab sub assembly having a production bore (74*a*) providing fluid communication between said production bores of said tree assembly and the tubing hanger housing, and said stab sub assembly having an annulus bore (74*b*) providing fluid communication between said annulus bores of said tree assembly and the tubing hanger housing.

26. The well assembly of claim 25, wherein the tubing hanger housing (24) is adapted for a range of vertical elevations relative to the wellhead housing (14).

27. The well assembly of claim 25, wherein said lower assembly production annulus (32*a*) being in fluid communication with said annulus bore (24*b*) of the tubing hanger housing (24).

28. In a well assembly having a wellhead housing (14) defining a wellhead bore, an inner casing string (18) coupled to the wellhead housing and extending down a well bore (B) to a producing zone (Z), and a production tubing string (22) connected to a tubing hanger housing (24), the improvement comprising:

a lower assembly (32) coupled to a lower end of the tubing hanger housing and having a bore therethrough, the production tubing string extending through said lower assembly bore and defining a lower assembly production annulus (32*a*) between said lower assembly and the production tubing string, and said lower assembly including a movement prevention locking apparatus (40) locking said lower assembly to the inner casing string.

29. The well assembly of claim 28, wherein said lower assembly (32) is retrievable.

30. The well assembly of claim 28, wherein said movement prevention locking apparatus (40) locks said lower assembly (32) to a non-profiled surface of the inner casing string.

31. In a well assembly having a wellhead housing (14) defining a wellhead bore, a string of production casing (18) extending down a well bore (B) and connected to a production casing hanger (18*a*) coupled to the wellhead housing, and a production tubing string (22) connected to a tubing hanger housing (24), the improvement comprising:

a lower assembly (32) connected to the tubing hanger housing and having a bore therethrough, the production tubing string extending through said lower assembly bore and defining a lower assembly production annulus (32*a*) between said lower assembly and the production tubing string, and said lower assembly including a movement prevention locking apparatus (40) locking said lower assembly to a non-profiled surface of the production casing.

32. The well assembly of claim 31, wherein said lower assembly (32) is retrievable.

* * * * *